US009297272B2

(12) United States Patent
Drozdenko et al.

(10) Patent No.: US 9,297,272 B2
(45) Date of Patent: Mar. 29, 2016

(54) GROUNDING FOR FAN BLADES ON AN UNDERBLADE SPACER

(71) Applicant: United Technologies Corporation, Hartford, CT (US)

(72) Inventors: Lee Drozdenko, Bristol, CT (US); Allan R. Penda, Amston, CT (US)

(73) Assignee: United Technologies Corporation, Hartford, CT (US)

( * ) Notice: Subject to any disclaimer, the term of this patent is extended or adjusted under 35 U.S.C. 154(b) by 940 days.

(21) Appl. No.: 13/658,887

(22) Filed: Oct. 24, 2012

(65) Prior Publication Data

US 2014/0109546 A1 Apr. 24, 2014

(51) Int. Cl.

| | |
|---|---|
| ***F01D 5/30*** | (2006.01) |
| ***F01D 21/14*** | (2006.01) |
| ***F04D 29/02*** | (2006.01) |
| ***F04D 29/32*** | (2006.01) |

(52) U.S. Cl.

CPC ..... *F01D 21/14* (2013.01); *F01D 5/3007* (2013.01); *F04D 29/023* (2013.01); *F04D 29/322* (2013.01); *F05D 2220/36* (2013.01); *F05D 2300/50* (2013.01); *F05D 2300/614* (2013.01)

(58) Field of Classification Search

CPC ..... F01D 5/30; F01D 5/3007; F01D 5/3015; F01D 5/3053; F01D 5/32; F01D 5/323; F01D 5/326

See application file for complete search history.

(56) References Cited

U.S. PATENT DOCUMENTS

| | | | |
|---|---|---|---|
| 4,274,697 | A | 6/1981 | Dodge et al. |
| 4,802,824 | A | 2/1989 | Gastebois et al. |
| 5,123,813 | A | 6/1992 | Przytulski et al. |
| 6,004,101 | A | 12/1999 | Schilling et al. |
| 7,462,074 | B1 | 12/2008 | Devlin et al. |
| 7,780,419 | B1 | 8/2010 | Matheny et al. |
| 2002/0071760 | A1 | 6/2002 | Dingwell et al. |
| 2011/0142644 | A1 | 6/2011 | Fritz et al. |
| 2012/0003100 | A1 | 1/2012 | James et al. |

FOREIGN PATENT DOCUMENTS

| | | |
|---|---|---|
| EP | 2353830 | 8/2011 |
| EP | 2405101 | 1/2012 |

OTHER PUBLICATIONS

European Search Report for European Patent Application No. 12196763.2 completed Feb. 6, 2013.

International Preliminary Report on Patentability for International Application No. PCT/US2013/065335 mailed May 7, 2015.

International Search Report and Written Opinion for International Application No. PCT/US2013/065335 completed on Aug. 18, 2014.

*Primary Examiner* — Nathaniel Wiehe

*Assistant Examiner* — Jeffrey A Brownson

(74) *Attorney, Agent, or Firm* — Carlson, Gaskey & Olds, PC

(57) ABSTRACT

A fan rotor includes a rotor body with at least one slot receiving a fan blade. The fan blade has an outer surface, at least at some areas, formed of a first material and an airfoil extending from a dovetail. The dovetail is received in the slot. A spacer is positioned radially inwardly of the dovetail biasing the fan blade against the slot. The spacer includes a grounding element, which is in contact with a portion of the dovetail formed of a second material that is more electrically conductive than the first material. The grounding element is in contact with a rotating element that rotates with the rotor. The rotating element is formed of a third material. The first material is less electrically conductive than the third material. The grounding and rotating elements form a ground path from the portion of the dovetail into the rotor.

22 Claims, 2 Drawing Sheets

GROUNDING FOR FAN BLADES ON AN UNDERBLADE SPACER

BACKGROUND OF THE INVENTION

This application relates to a structure for electrically grounding fan blades for use in a gas turbine engine.

Gas turbine engines are known, and typically include a fan delivering air into a compressor section. In the compressor section, the air is compressed and then delivered into a combustion section. The compressed air is mixed with fuel and burned in the combustion section. Products of this combustion pass downstream to drive turbine rotors.

The fan blades are subject to a large volume of air moving across an airfoil. This can build up a large static electric charge. Conventionally, the fan blades were formed of a conductive metal that was grounded to a hub that mounts the fan blade. As such, the charge would dissipate.

More recently, fan blades have become larger. One factor allowing the larger fan blades is the use of a gear reduction between a turbine driven spool, which drives the fan blade, and the spool. The gear reduction allows a single turbine rotor to drive both a compressor section and the fan, but at different speeds.

As the size of the fan blade has increased, its weight has also increased. As such, efforts have been made to reduce the weight of fan blades. One modification is to change the material for the fan blade from titanium to aluminum. The aluminum fan blades have been covered with a polyurethane coating and fabric wear pads to protect the aluminum. These materials have insulation qualities and, thus, the blade may not be electrically grounded to a rotor.

SUMMARY OF THE INVENTION

In a featured embodiment, a fan rotor for use in a gas turbine engine has a rotor body with at least one slot receiving a fan blade. The fan blade has an outer surface, at least at some areas, formed of a first material and an airfoil extending from a dovetail. The dovetail is received in the slot. A spacer is positioned radially inwardly of a radially inner face of the dovetail, and biases the fan blade against the slot. The spacer includes a grounding element. The grounding element is in contact with a portion of the dovetail formed of a second material that is more electrically conductive than the first material. The grounding element is in contact with a rotating element that rotates with the rotor. The rotating element is formed of a third material. The first material is less electrically conductive than the third material. The grounding element and rotating element together form a ground path from the portion of the dovetail into the rotor.

In another embodiment according to the previous embodiment, the first material includes an outer coating that is relatively non-conductive compared to the second and third materials.

In another embodiment according to any of the previous embodiments, the radially inner portion of the dovetail is not provided with the outer coating and is the portion of the dovetail.

In another embodiment according to any of the previous embodiments, the second material is aluminum, and the third material includes titanium.

In another embodiment according to any of the previous embodiments, the grounding element is formed of a material that is more electrically conductive than the first material.

In another embodiment according to any of the previous embodiments, the grounding element is formed of a metal fabric.

In another embodiment according to any of the previous embodiments, the grounding element is formed of a silver-plated aluminum metal fabric.

In another embodiment according to any of the previous embodiments, the rotating element is separate from the rotor.

In another embodiment according to any of the previous embodiments, the rotating element is a lock ring which secures the fan blade within the rotor. The grounding element contacts the lock ring, which contacts the rotor to provide the grounding path.

In another embodiment according to any of the previous embodiments, the spacer is bowed such that it biases the dovetail against surfaces of the slot. The grounding element is provided on a radially outer portion of the grounding element.

In another featured embodiment, a gas turbine engine has a fan section, a compressor section, a combustor section, and at least one turbine rotor. The at least one turbine rotor drives a compressor rotor. The at least one turbine rotor also drives a fan rotor of the fan section through a gear reduction. The fan blade has an outer surface, at least at some areas, formed of a first material and has an airfoil extending from a dovetail, which is received in the slot. A spacer is positioned radially inwardly of a radially inner face of the dovetail, and biases the fan blade against the slot. The spacer includes a grounding element. The grounding element is in contact with a portion of the dovetail formed of a second material that is more electrically conductive than the first material. The grounding element is in contact with a rotating element that rotates with the rotor. The rotating element is formed of a third material. The first material is less electrically conductive than the third material. The grounding element and rotating element together form a ground path from the portion of the dovetail into the rotor.

In another embodiment according to the previous embodiment, the first material includes an outer coating that is relatively non-conductive compared to the second and third materials.

In another embodiment according to any of the previous embodiments, the radially inner portion of the dovetail is not provided with the outer coating and is the portion of the dovetail.

In another embodiment according to any of the previous embodiments, the second material is aluminum, and the third material includes titanium.

In another embodiment according to any of the previous embodiments, the grounding element is formed of a material that is more electrically conductive than the first material.

In another embodiment according to any of the previous embodiments, the grounding element is formed of a metal fabric.

In another embodiment according to any of the previous embodiments, the grounding element is formed of a silver-plated aluminum metal fabric.

In another embodiment according to any of the previous embodiments, the rotating element is separate from the rotor.

In another embodiment according to any of the previous embodiments, the rotating element is a lock ring that secures the fan blade within the rotor. The grounding element contacts the lock ring, which contacts the rotor to provide the grounding path.

In another embodiment according to any of the previous embodiments, the spacer is bowed such that it biases the dovetail against surfaces of the slot. The grounding element is provided on a radially outer portion of the grounding element.

In another featured embodiment, a grounding element is to be associated with a spacer, and to ground a blade to a rotor receiving the blade. The grounding element has a top surface to provide a contact point with a blade, and an inner area to be positioned inward of the spacer when the grounding element is received on a spacer.

In another embodiment according to the previous embodiment, the grounding element is formed of a metal fabric grounding material.

These and other features of the invention will be better understood from the following specifications and drawings, the following of which is a brief description.

DETAILED DESCRIPTION

Figure 1A:
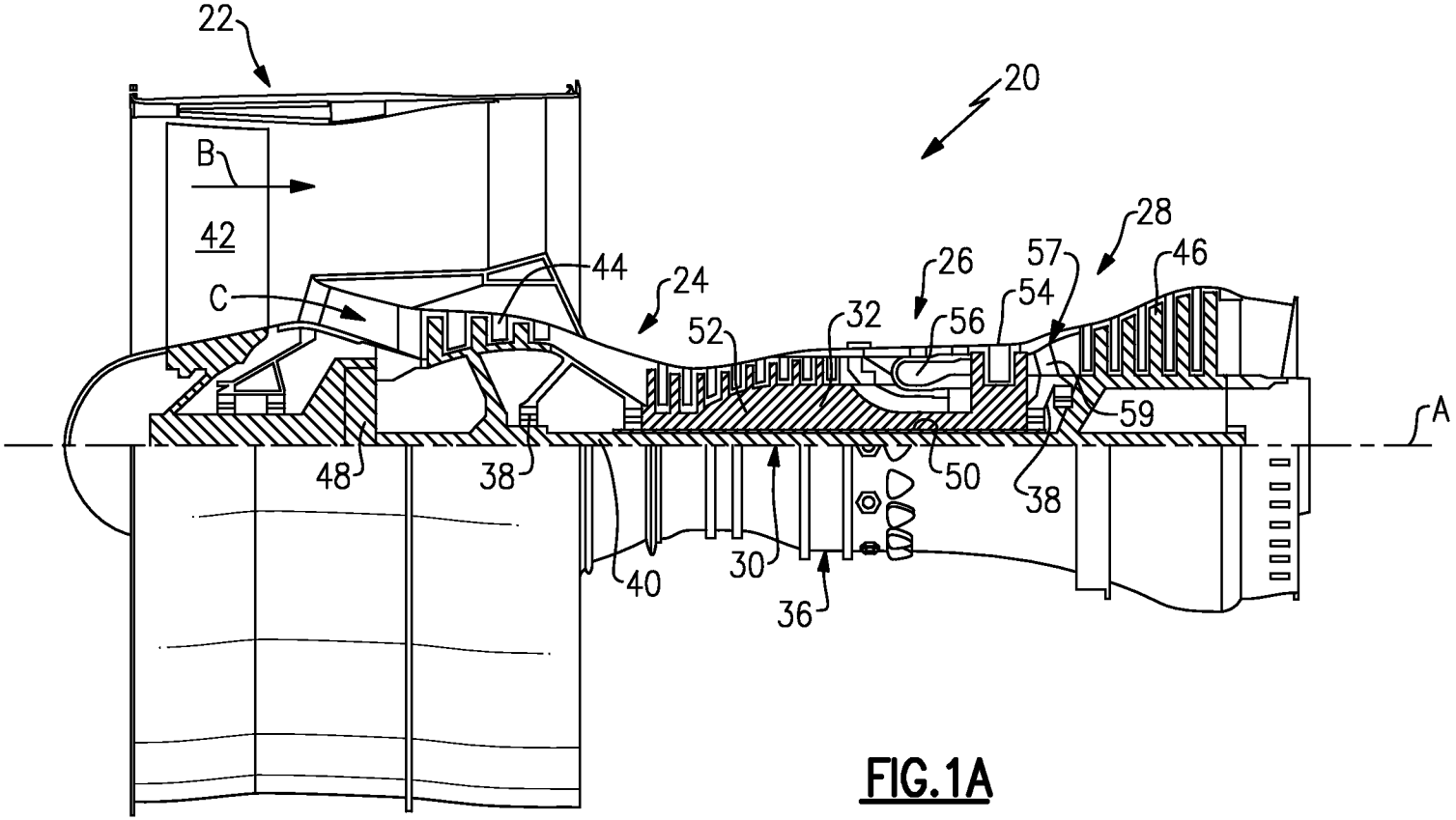
FIG. 1A shows an exemplary gas turbine engine.

FIG. 1A schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flowpath B while the compressor section 24 drives air along a core flowpath C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\,^\circ\text{R})/(518.7^\circ\text{R})]^{0.5}$. The "Low corrected fan tip speed" as disclosed herein according to one non-limiting embodiment is less than about 1150 ft/second.

Figure 1B:
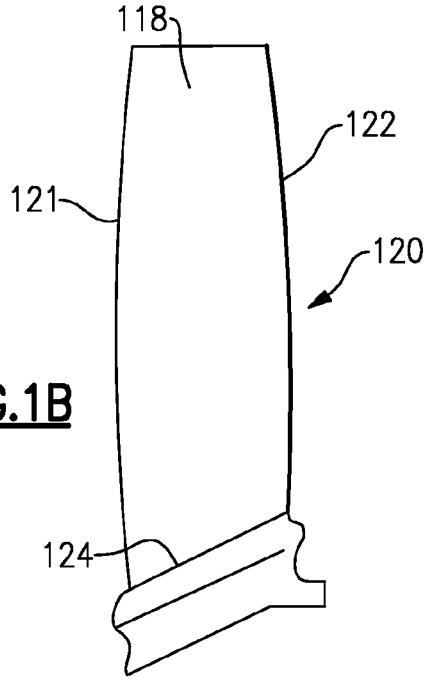
FIG. 1B shows an aluminum fan blade.

A fan blade 120 is illustrated in FIG. 1B having an airfoil 118 extending radially outwardly from a dovetail or root 124. A leading edge 121 and a trailing edge 122 define the forward and rear limits of the airfoil 118. Fan blade 120 may be used in an engine such as engine 20.

Figure 1C:
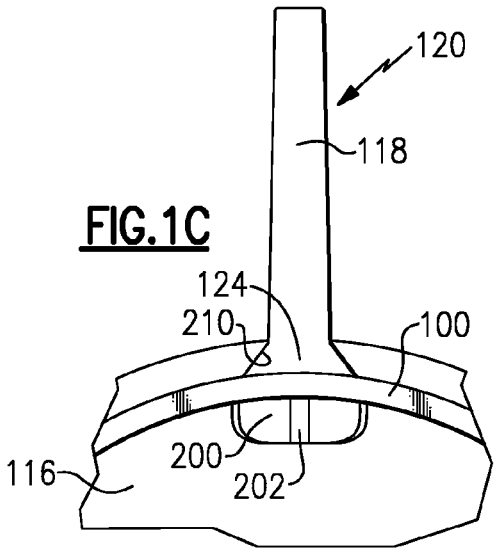
FIG. 1C shows the aluminum fan blade mounted into a rotor.

As shown in FIG. 1C, a fan rotor 116 receives the dovetail 124 in a slot 210 to mount the fan blade 120 with the airfoil 118 extending radially outwardly. As the rotor is driven to rotate, it carries the fan blade 120 with it.

A lock ring 100 locks the blades 120 within the rotor 116 and rotates with the rotor 116.

As mentioned above, the lock ring 100 and rotor 116 may be formed of titanium or a titanium alloy, while the blade 120 may be formed of aluminum, but coated with a non-conductive coating, such as polyurethane coating 125 (see FIG. 3), or including fabric pads. As such, the fan blade 120 is not grounded.

As can be seen in FIG. 1C, a resilient spacer 200 holds the dovetail 120 against the groove 210. A conductive element 202 contacts the lock ring 100.

Figure 2:
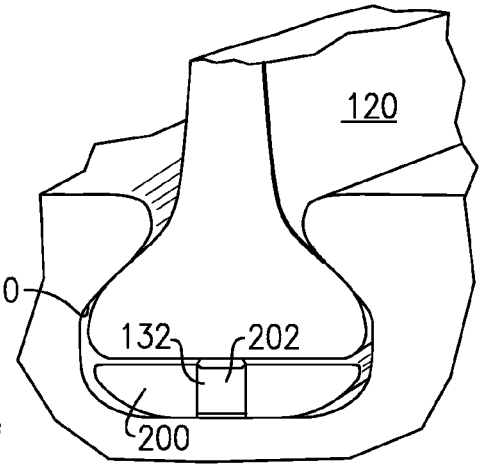
FIG. 2 shows details of a grounding arrangement.
Figure 3:
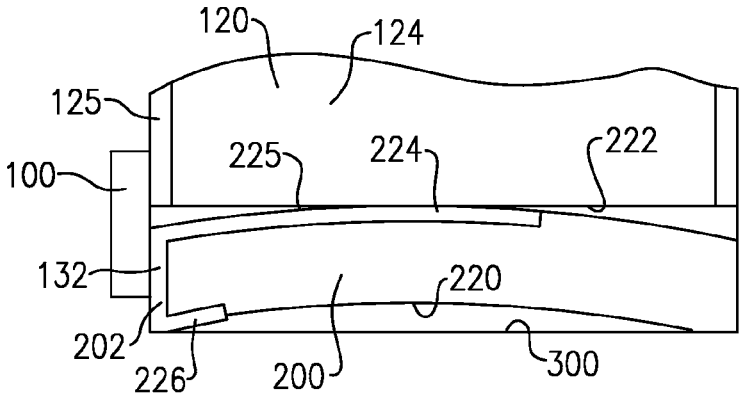
FIG. 3 is another view of the FIG. 2 embodiment.

As shown in FIG. 2, the conductive element 202 has a forward contact face 132 which will contact the lock ring 100. FIG. 3 shows the lock ring 100 in contact with the forward face 132. The spacer 200 has a curved or bowed shape, as shown in FIG. 3, along an axis of rotation of the rotor. Thus, a radially inner surface 220 is spaced away from a bottom 300 of the slot 210.

When the dovetail 124 is moved into the slot 210, it forces the spacer away from a free position, such that it is less bowed. Thus, there is a bias force from the spacer 200 holding the blade in contact with the walls of the slot 210. The grounding element 202 is associated with the spacer 200. The blade is provided with the coating 125 at locations other than a bottom surface 222. Bottom surface 222 is generally uncoated, and thus a contact point 224 from the conductive element provides an electrical connection from the blade 120 through a top surface 225 the conductive element 202, and into the lock ring 100.

An inner area 226 is radially inward of the spacer 200.

In embodiments, the conductive element may be formed of a metal fabric grounding material. Appropriate materials may be EMI shielded conductive elastomers, such as those available under the trademarks CHO-SEAL® or CHO-SIL® from Chomerics. Of course, other materials may be utilized. A silver-plated aluminum fabric material available as CHO-SEAL1298 is presently preferred; however, any number of other conductive materials may be utilized.

Locating the grounding element radially inward and at the platform provides a surface which is more protected from the elements then if the contact were more radially outward. As can be appreciated, the lock ring 100 contacts the rotor 116. The lock ring 100 also contacts the grounding element 202 at forward face 132, and provides an electrical connection through contact portion 224. Bottom surface 222 of the dovetail 124 is the underlying aluminum substrate, and thus provides a good conductive surface such that static electricity may be drained from the fan blade 120, and to the rotor 116. The location of the contact is such that it is generally protected from the elements such that there is unlikely to be corrosion at the connection.

As can be appreciated, the coating material 125 is less electrically conducive than the aluminum at surface 222, or the lock ring 100.

While the disclosed embodiment provides contact between the grounding element 202 and the lock ring 100, it is also possible to have the grounding element contact the rotor 116 directly.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A fan rotor for use in a gas turbine engine comprising:

a rotor body having at least one slot receiving a fan blade;

said fan blade having an outer surface, at least at some areas, formed of a first material and having an airfoil extending from a dovetail, said dovetail received in said slot;

a spacer positioned radially inwardly of a radially inner face of said dovetail, and biasing said fan blade against said slot, said spacer including a grounding element; and the grounding element in contact with a portion of said dovetail formed of a second material that is more electrically conductive than said first material, and said grounding element being in contact with a rotating element that rotates with said rotor, said rotating element being formed of a third material, and said first material being less electrically conductive than said third material, said grounding element and said rotating element together forming a ground path from said portion of said dovetail into said rotor.

2. The fan rotor as set forth in claim 1, wherein said first material includes an outer coating that is relatively non-conductive compared to said second and third materials.

3. The fan rotor as set forth in claim 2, wherein said radially inner portion of said dovetail is not provided with said outer coating and is said portion of said dovetail.

4. The fan rotor as set forth in claim 2, wherein said second material is aluminum, and said third material includes titanium.

5. The fan rotor as set forth in claim 1, wherein said grounding element is formed of a material that is more electrically conductive than said first material.

6. The fan rotor as set forth in claim 5, wherein said grounding element is formed of a metal fabric.

7. The fan rotor as set forth in claim 5, wherein said grounding element is formed of a silver-plated aluminum metal fabric.

8. The fan rotor as set forth in claim 1, wherein said rotating element is separate from said rotor.

9. The fan rotor as set forth in claim 8, wherein said rotating element is a lock ring which secures said fan blade within said rotor, said grounding element contacts said lock ring, and said lock ring contacts said rotor to provide said grounding path.

10. The fan rotor as set forth in claim 1, wherein said spacer is bowed such that it biases said dovetail against surfaces of said slot, and said grounding element is provided on a radially outer portion of said spacer.

11. A gas turbine engine comprising:

a fan section, a compressor section, a combustor section, and at least one turbine rotor, said at least one turbine rotor driving a compressor rotor, and said at least one turbine rotor also driving a fan rotor of said fan section through a gear reduction;

said fan blade having an outer surface, at least at some areas, formed of a first material and having an airfoil extending from a dovetail, said dovetail received in said slot;

a spacer positioned radially inwardly of a radially inner face of said dovetail, and biasing said fan blade against said slot, said spacer including a grounding element; and the grounding element in contact with a portion of said dovetail formed of a second material that is more electrically conductive than said first material, and said grounding element being in contact with a rotating element that rotates with said rotor, said rotating element being formed of a third material, and said first material being less electrically conductive than said third material, said grounding element and said rotating element together forming a ground path from said portion of said dovetail into said rotor.

12. The gas turbine engine as set forth in claim 11, wherein said first material includes an outer coating that is relatively non-conductive compared to said second and third materials.

13. The gas turbine engine as set forth in claim 12, wherein said radially inner portion of said dovetail is not provided with said outer coating and is said portion of said dovetail.

14. The gas turbine engine as set forth in claim 12, wherein said second material is aluminum, and said third material includes titanium.

15. The gas turbine engine as set forth in claim 11, wherein said grounding element is formed of a material that is more electrically conductive than said first material.

16. The gas turbine engine as set forth in claim 15, wherein said grounding element is formed of a metal fabric.

17. The gas turbine engine as set forth in claim 15, wherein said grounding element is formed of a silver-plated aluminum metal fabric.

18. The gas turbine engine as set forth in claim 11, wherein said rotating element is separate from said rotor.

19. The gas turbine engine as set forth in claim 18, wherein said rotating element is a lock ring which secures said fan blade within said rotor, said grounding element contacts said lock ring, and said lock ring contacts said rotor to provide said grounding path.

20. The gas turbine engine as set forth in claim 11, wherein said spacer is bowed such that it biases said dovetail against surfaces of said slot, and said grounding element is provided on a radially outer portion of said grounding element.

21. A grounding element to be associated with a spacer, and to ground a blade to a rotor receiving the blade, the grounding element comprising:

a top surface to provide a contact point with a blade, and an inner area to be positioned inward of the spacer when the grounding element is received on a spacer.

22. The grounding element as set forth in claim 21, wherein said grounding element is formed of a metal fabric grounding material.

* * * * *